US009301904B2

(12) United States Patent
Paxson et al.

(10) Patent No.: US 9,301,904 B2
(45) Date of Patent: Apr. 5, 2016

(54) FEEDING KIT

(71) Applicant: Mattel, Inc., El Segundo, CA (US)

(72) Inventors: Ryan Paxson, East Aurora, NY (US); Jacob J. Clark, East Aurora, NY (US); Domenic T. Gubitosi, East Aurora, NY (US); Charlie Smith, East Amherst, NY (US)

(73) Assignee: Mattel, Inc., El Segundo, CA (US)

( * ) Notice: Subject to any disclaimer, the term of this patent is extended or adjusted under 35 U.S.C. 154(b) by 206 days.

(21) Appl. No.: 14/021,303

(22) Filed: Sep. 9, 2013

(65) Prior Publication Data

US 2014/0074165 A1 Mar. 13, 2014

Related U.S. Application Data

(60) Provisional application No. 61/698,860, filed on Sep. 10, 2012.

(51) Int. Cl.
*A61J 17/00* (2006.01)
*A61J 17/02* (2006.01)

(52) U.S. Cl.
CPC ..... *A61J 17/02* (2013.01)

(58) Field of Classification Search
CPC ..... A61J 17/00; A61J 17/006; A61J 1/1418; A61J 9/00; A61J 9/085; A61J 11/0015; A61J 11/008; A61J 17/02; A61J 7/00
USPC ..... 606/234–236; 604/77; 215/11.1
See application file for complete search history.

(56) References Cited

U.S. PATENT DOCUMENTS

| | | | | |
|---|---|---|---|---|
| 451,166 | A | 4/1891 | Bryant | |
| 1,349,546 | A | 8/1920 | Benton | |
| 2,247,018 | A | 6/1941 | Henning | |
| 2,612,165 | A | 9/1952 | Szuderski | |
| 2,665,693 | A | 1/1954 | Pecora | |
| 2,824,561 | A | 2/1958 | Mueller | |
| 3,143,866 | A | 8/1964 | Frohbieter | |
| 3,267,937 | A * | 8/1966 | Verschoor | 606/236 |
| D210,613 | S | 3/1968 | Moore | |
| 3,742,950 | A | 7/1973 | Endrody | |
| 4,192,307 | A | 3/1980 | Baer | |

(Continued)

FOREIGN PATENT DOCUMENTS

| | | | |
|---|---|---|---|
| CN | 301283059 | S | 7/2010 |
| CN | 301430604 | S | 1/2011 |

(Continued)

OTHER PUBLICATIONS

International Search Report for PCT/US2013/058971, dated Dec. 12, 2013.

(Continued)

*Primary Examiner* — Katherine M Shi
(74) *Attorney, Agent, or Firm* — Edell, Shapiro & Finnan, LLC

(57) ABSTRACT

A feeding kit forming a storage and preparation assembly for infant feeding implements that includes a receptacle to receive a teether and a plurality of wells to form food/drink inserts for the teether. The teether includes a lid that is removably coupled to a feeding portion, such that the inserts may be inserted into the feeding portion, a portion which includes a feeding member with a plurality of apertures.

19 Claims, 9 Drawing Sheets

(56) References Cited

U.S. PATENT DOCUMENTS

| | | | | |
|---|---|---|---|---|
| 5,364,348 | A | 11/1994 | Berry, Sr. | |
| D353,461 | S | 12/1994 | Byrd | |
| 5,512,047 | A * | 4/1996 | Dvorak | 604/77 |
| 5,606,871 | A * | 3/1997 | Hansen et al. | 62/457.5 |
| 5,908,440 | A | 6/1999 | McCloskey et al. | |
| 6,126,678 | A | 10/2000 | Aaltonen | |
| 6,793,193 | B2 | 9/2004 | de Groote | |
| 7,001,357 | B2 * | 2/2006 | Berry, Sr. | 604/77 |
| 7,901,375 | B2 | 3/2011 | Dunn et al. | |
| 2004/0075038 | A1 | 4/2004 | Hang | |
| 2004/0226905 | A1 * | 11/2004 | Diniaco | 215/11.1 |
| 2006/0142800 | A1 | 6/2006 | Charameda et al. | |
| 2009/0005810 | A1 | 1/2009 | Bonazza | |
| 2010/0230372 | A1 * | 9/2010 | Lo | 215/11.1 |
| 2010/0230373 | A1 | 9/2010 | Lo | |
| 2011/0271708 | A1 | 11/2011 | Baker et al. | |
| 2013/0338711 | A1 * | 12/2013 | Strazzeri | 606/235 |

FOREIGN PATENT DOCUMENTS

| | | | |
|---|---|---|---|
| CN | 201791098 | U | 4/2011 |
| CN | 101849887 | B | 6/2011 |
| CN | 201906224 | U | 7/2011 |
| CN | 301638814 | S | 8/2011 |
| CN | 102348447 | A | 2/2012 |
| CN | 302027623 | S | 8/2012 |
| CN | 302073536 | S | 9/2012 |
| FR | 2368674 | | 5/1978 |
| JP | 52034838 | | 3/1977 |
| JP | 2003322441 | | 11/2003 |
| WO | 2005002493 | | 1/2005 |

OTHER PUBLICATIONS www.amazon.com/Beaba-Mulitportion-Freezer-Tray-Green/dp/B0027UYT4O/ref=pd_bxgy_ba_img_y, "Beaba Multiportions Freezer Trays," 5 pages.

http://www.globaltoysandgames.com/pdetails.php?pid=8724, Fu Hong Industries Ltd., "Travel Set (Genius Feeder)", 1 page.

http://www.globaltoysandgames.com/pdetails.php?pid=8716, Fu Hong Industries Ltd., "Genius Feeder for Meat", 1 page.

http://www.globaltoysandgames.com/pdetails.php?pid=8718, Fu Hong Industries Ltd., "Genius Feeder for Fruit", 1 page.

* cited by examiner

FEEDING KIT

CROSS-REFERENCE TO RELATED APPLICATION

This application claims priority to and is based on U.S. Patent Application No. 61/698,860, filed Sep. 10, 2012, entitled "Feeding Kit," the entire disclosure of which is incorporated herein by reference in its entirety.

FIELD OF THE INVENTION

The present invention relates to infant feeding. More specifically, the present invention is a feeding kit which includes a teether and tray to provide parent-made food/drink inserts for the teether.

BACKGROUND OF THE INVENTION

As children begin to develop teeth, it may be soothing for the child to bite or gnaw on a toy, pacifier, or other similar objects. While there are many toys and teethers which serve this purpose, traditional teethers had to be taken away from a child in order to feed the child. Thus, for both convenience and comfort, some teethers began to include a housing or compartment for foodstuff so that an infant child could be fed while chewing/sucking on a teether. Additionally, if cold food is included within one of these teethers, the surface of the teether might soothe teething pain while the cold food soothes the gums. While many feeding teethers currently exist, a parent must first find the teether and then find or cut food to fit within the teether in order to use the teether as desired. Thus, a feeding kit that provides food/drink inserts shaped for the teether and convenient storage for the teether is desirable.

SUMMARY OF THE INVENTION

According to at least one embodiment of the present invention, a feeding kit comprises a teether and a housing. The teether comprises a lid including handle and a feeding portion removably coupled to the lid including a flexible feeding member. The housing comprises a receptacle configured to receive the teether and a plurality of wells, each well being sized to form an insert that may be inserted into the flexible feeding member.

BRIEF DESCRIPTION OF THE DRAWINGS

Like reference numerals have been used to identify like elements throughout this disclosure.

DETAILED DESCRIPTION OF THE INVENTION

Generally referring to FIGS. 1-8, at least one exemplary embodiment of a feeding kit in accordance with the present invention is shown. A feeding kit includes a teether and a housing that can receive the teether therein. Additionally, the housing includes various compartments or wells that can receive foodstuff, such that the foodstuff can be formed into inserts for the teether.

Figure 1:
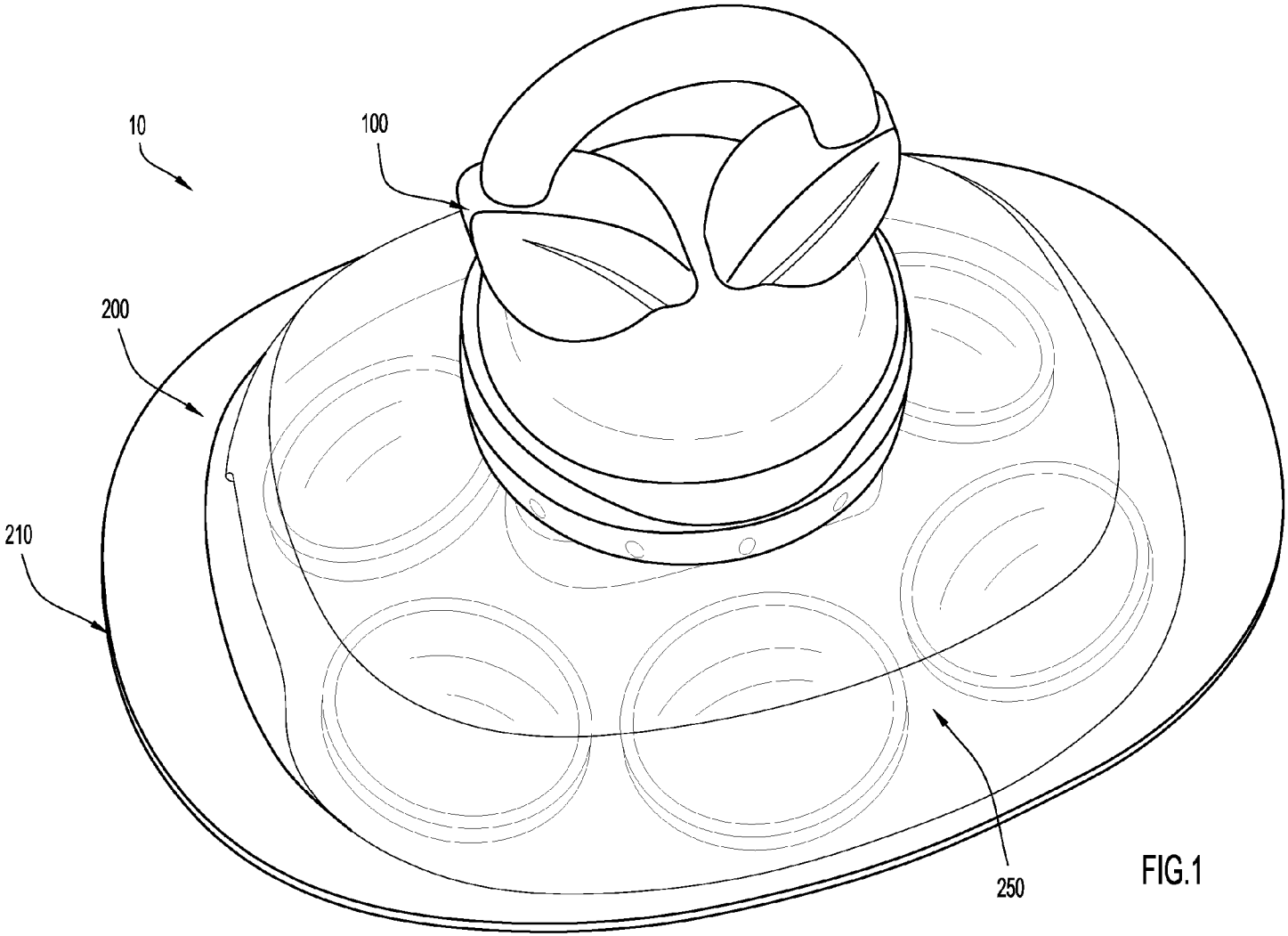
FIG. 1 shows a top perspective view of an exemplary embodiment of a feeding kit in accordance with the present invention.

Referring to FIG. 1, an exemplary feeding kit 10 in accordance with the present invention is shown. Feeding kit 10 includes a teether 100 and a housing 200. The housing 200 includes a tray 210 and a cover 250 that, together, can receive a teether 100 therein. However, the housing 200 is configured to receive various teethers, such as teether 100' (see FIG. 3) that are slight variants of teether 100 or similar in shape, size or configuration to teether 100. In some embodiments, teethers 100, 100' may include designs or indicia that give it the look of a plant, such as a strawberry. Thus, when a teether 100, 100' is inserted into housing 200, as shown in FIG. 1, the feeding kit 10 may appear to be storing a planted item therein, making it appealing to a young child.

Figure 3:
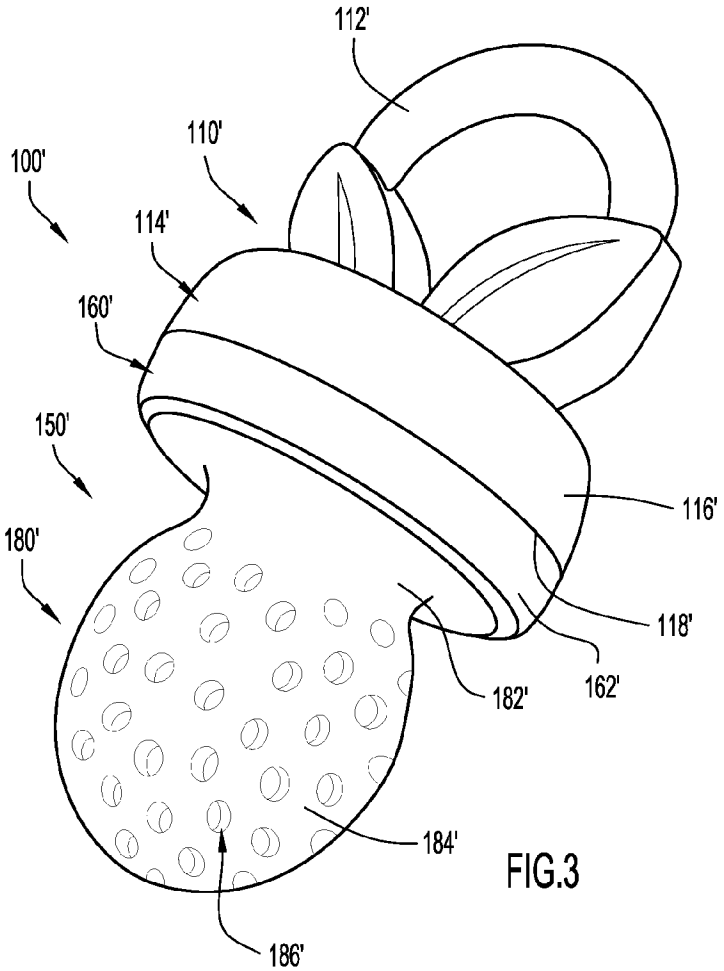
FIG. 3 shows a front perspective view of another exemplary embodiment of a teether in accordance with the present invention.
Figure 2:
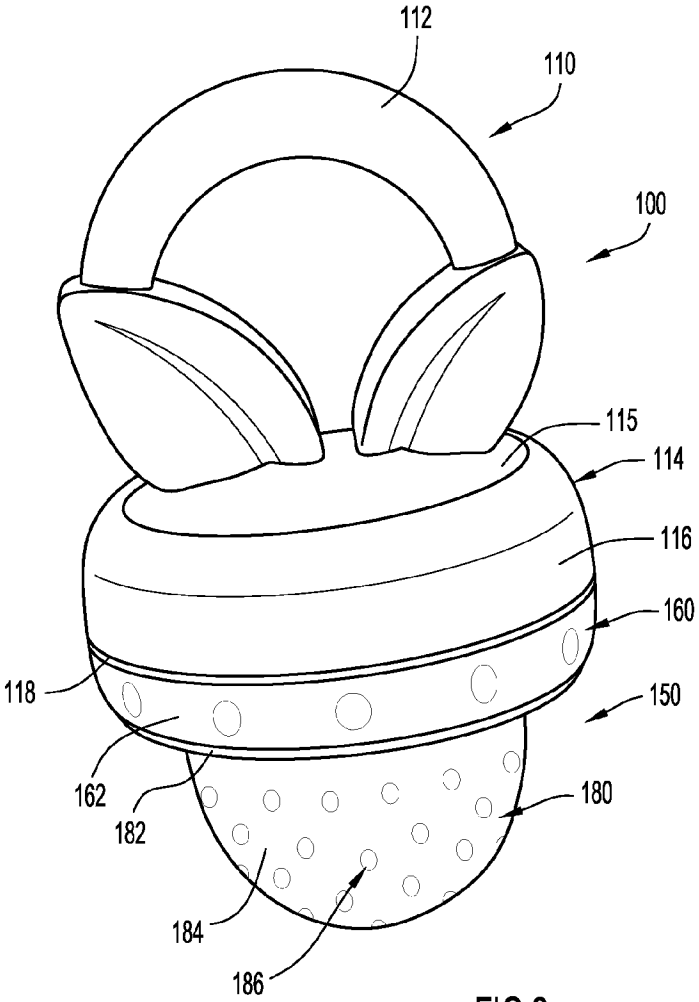
FIG. 2 shows a front perspective view of the teether from the exemplary embodiment of the feeding kit shown in FIG. 1.
Figure 4A:
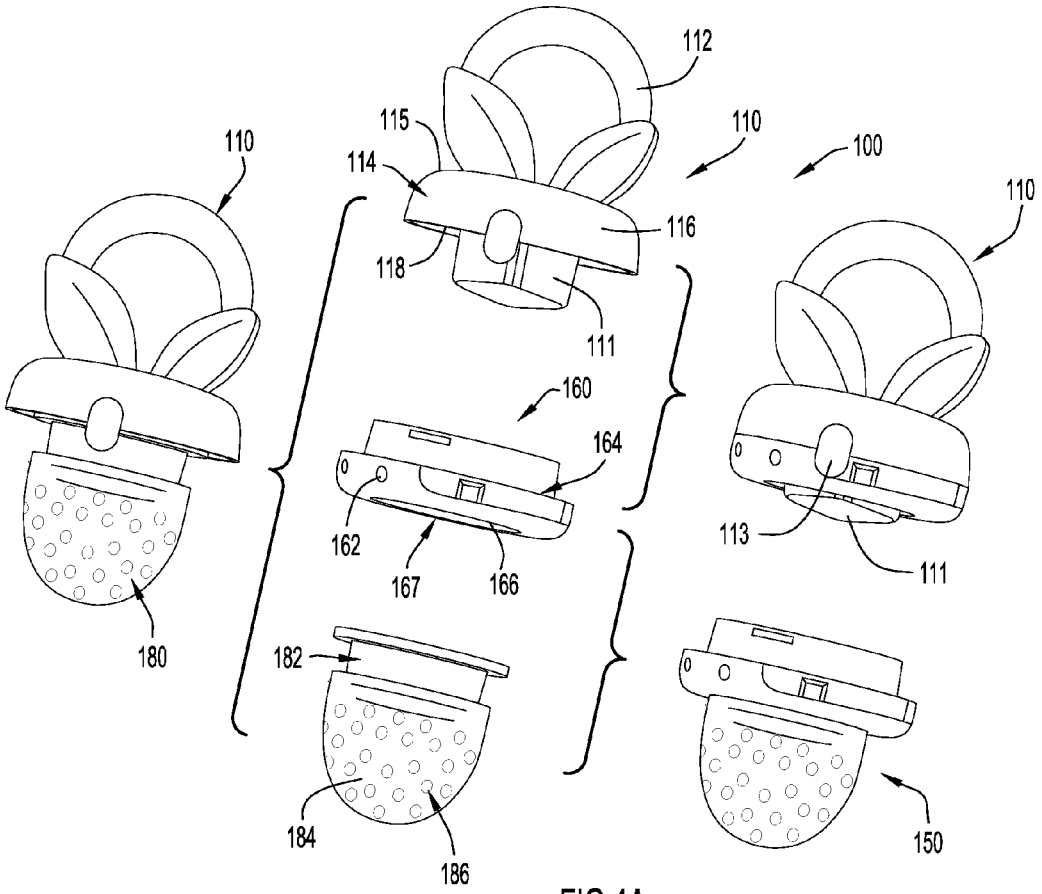
FIGS. 4A-C shows various exploded, perspective view of the teethers shown in FIGS. 2 and 3 with the lid decoupled from the feeding portion, FIGS. 4A-B showing the teether of FIG. 2 and FIG. 4C showing the teether of FIG. 3.
Figure 4B:
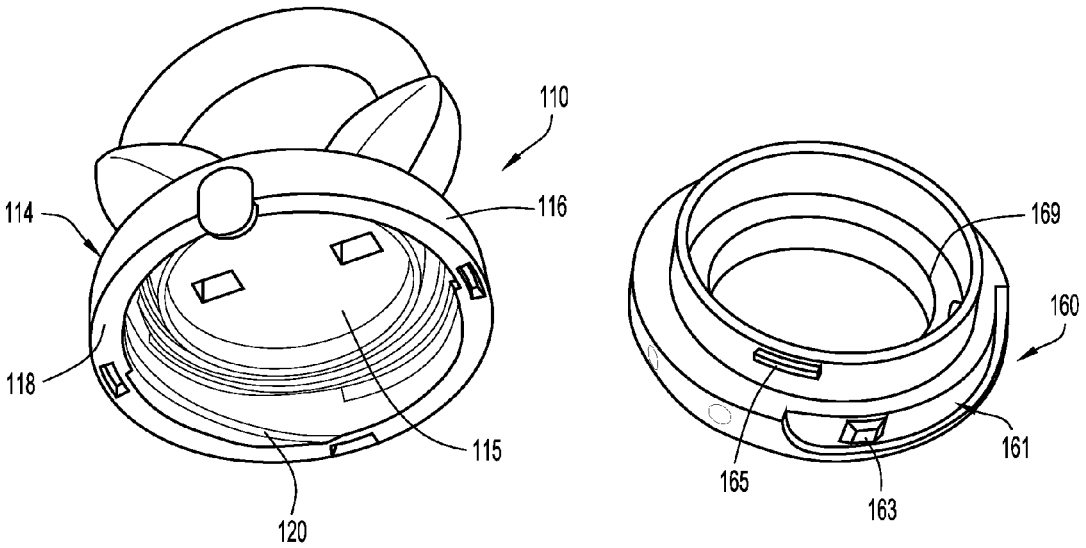
Figure 4C:
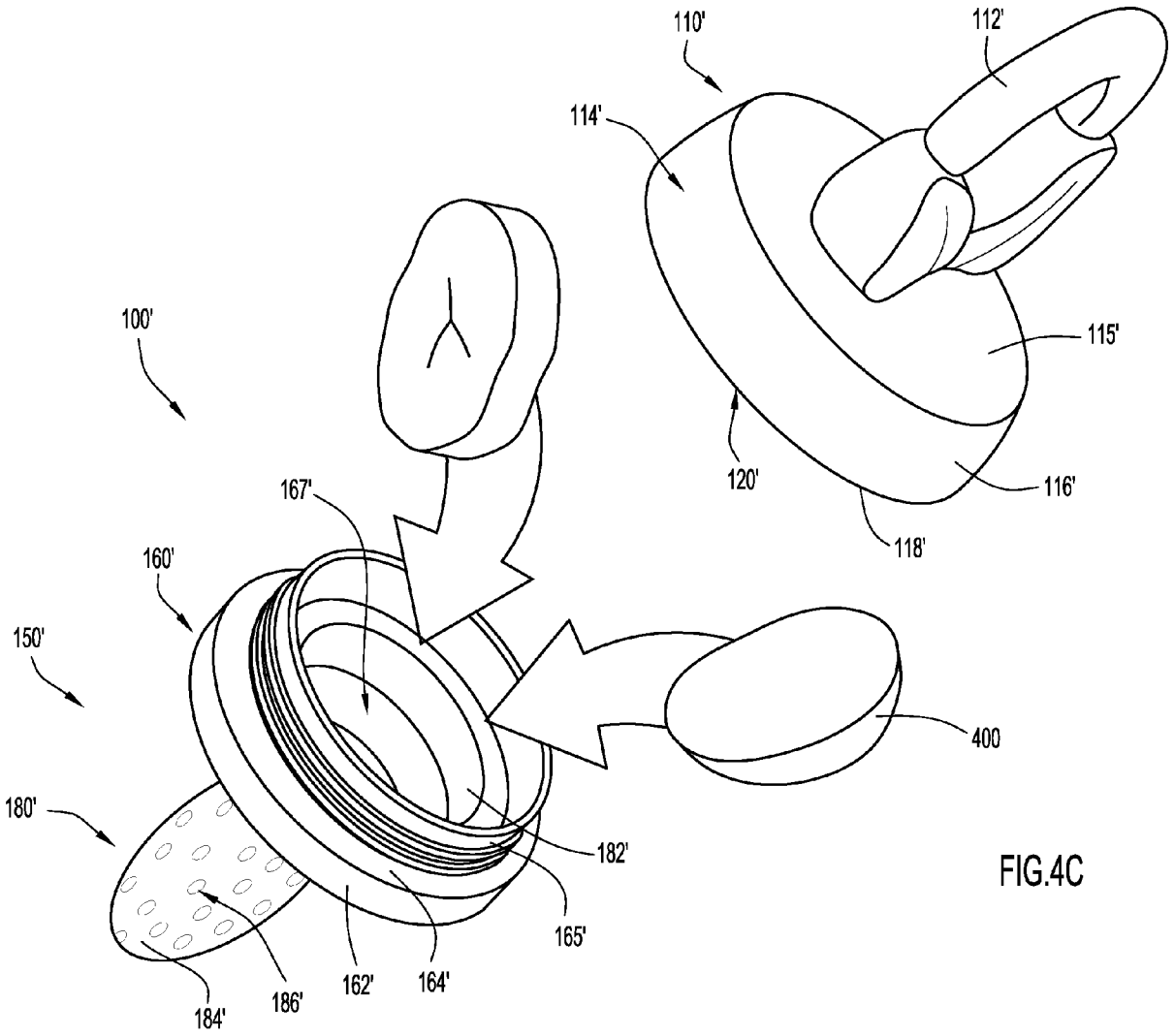
Figure 5:
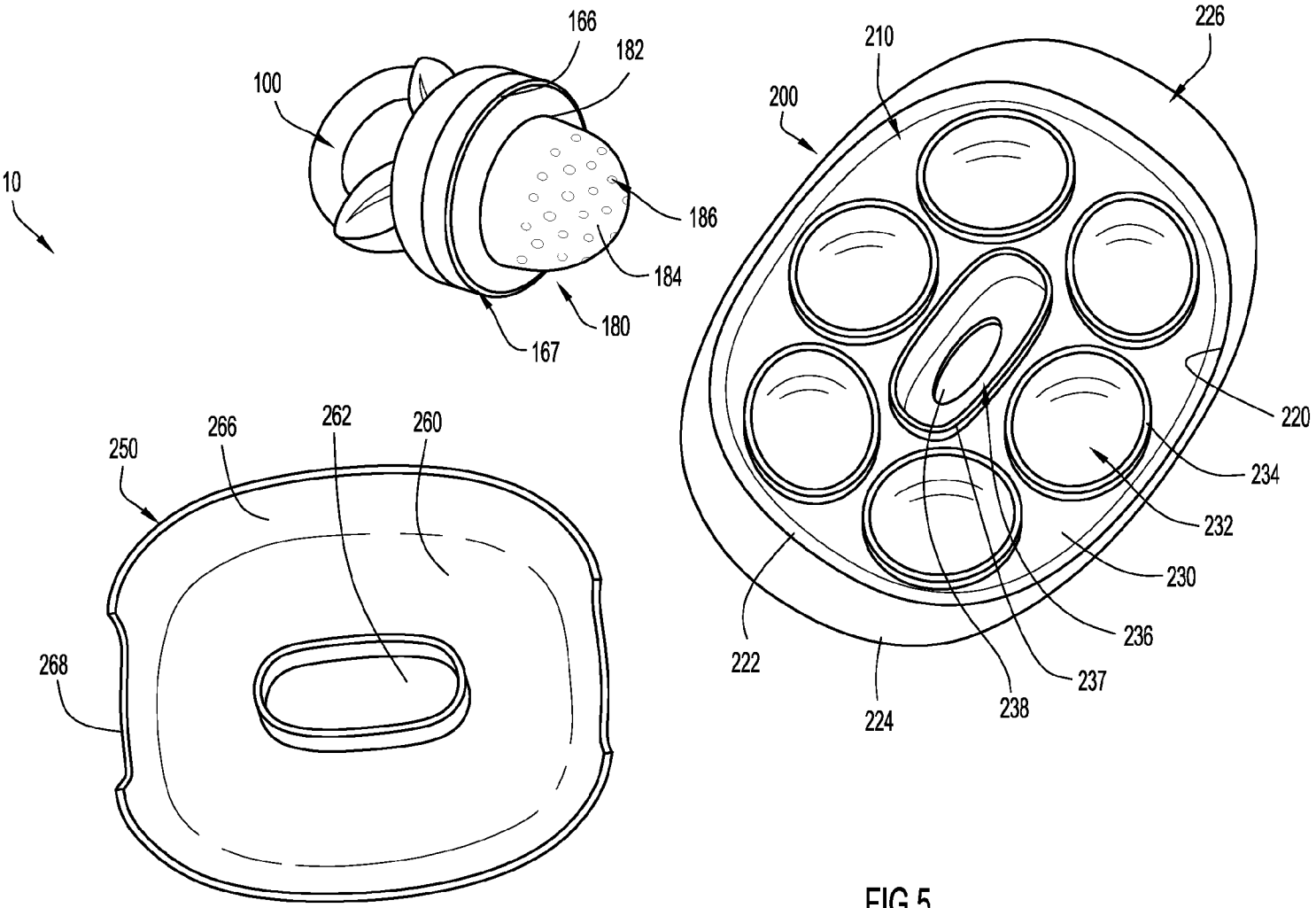
FIG. 5 shows a top perspective view of the feeding kit of FIG. 1.

Referring now to FIGS. 2-5, at least two exemplary embodiments of a teether are shown. Teether 100 is shown in FIGS. 2 and 5 while teether 100' is shown in FIGS. 3 and 4C. Since teether 100 and teether 100' are similar, each of the parts and features of teethers 100, 100' are labeled with like reference numbers for simplicity and ease of reference. However, teethers 100, 100' also include slightly different features as well. For example, each teether includes a cover or lid 110, 110' and a feeding portion 150, 150', but feeding portion 150 has a substantially half-circular shape while feeding portion 150' is nearly completely circular.

Referring now to FIG. 2, teether 100 includes a cover or lid 110 and a feeding portion 150. The lid 110 includes a base 114 formed from a top surface 115 and an outer wall 116 extending downwardly to an edge 118, such that an inner compartment or cavity is defined within base 114 above edge 118 and between wall 116 and top surface 115. Lid 110 also includes a handle 112 which may be coupled to or formed integrally with base 114 such that it also extends outwardly from top surface 115, but oppositely from outer wall 116. The handle 112 may be substantially tubular and arcuate and may, together with various indicia, form a ring extending from the base 114 in order to provide a grippable portion for an infant or baby using teether 100.

Still referring to FIG. 2, but with reference to FIGS. 4A-B as well, teether 100 also includes a feeding portion 150. Feeding portion 150 includes a substantially annular base portion 160 formed from a top surface 164 (see FIG. 4A-B), bottom surface 166 (see FIG. 4A-B), an exterior wall 162 extending around the periphery therebetween, and an opening 167 extending therethrough (see FIG. 4A-B; see opening 167' of FIG. 4C for comparison). Furthermore, feeding portion 150 also includes a teething portion 180 formed from a rigid but malleable and flexible substance (such as a soft rubber or plastic compound). Teething portion 180 may be coupled to or formed integrally with base portion 160 and may extend outwardly from bottom surface 166 of base portion 160.

In some embodiments, teething portion 180 may extend from or through opening 167. Alternatively or additionally, in some embodiments, such as the embodiment shown in FIGS. 2 and 4A-B, teething portion 180 may include an engagement portion 182 that may be coupled to the lower surface 166, exterior wall 162 and/or opening 167 of base portion 160. In this exemplary embodiment, the engagement portion 182 includes two ridges and a detent extending therebetween, such that the detent may engage an interior ridge 169 (see FIG. 4B) included on the base 160, thereby removably mounting teething portion 180 to base 160. In this embodiment, the flexible teething portion 180 may simply be bent or otherwise deformed and then the detent of the engagement portion 182 may be aligned with the interior ridge 169. Then, the teething portion may be released and the teething portion's 180 resilient properties may return the teething portion 180 to its original shape, creating an engagement between teething portion 180 and base 160, as shown in FIG. 4A.

Regardless of how teething portion 180 is connected to base portion 160, teething portion 180 includes a teething member 184 and apertures 186 formed therein. In the embodiment shown in FIGS. 2 and 4A-B, the teething member 184 is shaped as a half circular member with apertures 186 included over the entirety of the surface. However, in other embodiments, teething member 184 may be shaped as desired. Similarly, apertures 186 may be any desirable size such that apertures 186 are large enough to allow small bits of foodstuff to pass therethrough, but small enough to prevent undesirably large pieces of foodstuff from passing therethrough. Additionally, any number of apertures 186 may be included, in any desirable pattern, in teething member 184.

Now referring to FIG. 3, another exemplary embodiment of a teether, teether 100' is shown from a front perspective. Similar to teether 100, teether 100' includes a lid or cover 110' with a base 114' and a handle 112' extending outwardly from the base 114'. The lid or cover 110' is removably coupled to a feeding portion 150' which also includes a base portion 160' that has a substantially annular exterior wall 162' and a teething portion 180'. In the exemplary embodiment shown in FIG. 3, the teething portion 180' includes a substantially circular teething member 184' having a plurality of apertures 186'. This shape may provide the feeding member with a collar or neck which may urge foodstuff to remain disposed proximate apertures 186' rather than being forced back up into the base portion 160'. However, since teething member 184' is flexible or malleable, the collar or neck of teething member 184' may expand in order to receive larger inserts within the teething member 184'. Despite the difference in shape, teething member 184' may still be coupled to base portion 160' via an engagement member 182', similar to the teething member 184 of teether 100.

Now referring to FIGS. 4A-C, teethers 100 and 100' are shown in various states of disassembly in order to illustrate the interplay between the various parts and how foodstuff may be inserted into the teethers 100. 100'. As mentioned above, the lids 110 and 110' may be removably coupled to the feeding portions 150, 150' in any desirable manner. In the embodiment shown in FIGS. 4A-B, the lid 110 may include a single thread 120 and the base 160 may include a single protrusion 165 (seen best in FIG. 4A), such that the protrusion 165 may be slidably introduced into the thread 120 in lid 110 in order to removably couple lid 110 to base 160. By comparison, in the embodiment shown in FIG. 4C, feeding portion 150' includes a threaded portion 165' while lid 110' includes interior threads 120' which allow lid 110' to be removably coupled to the feeding portion 150'.

Additionally, in the embodiment shown in FIGS. 2 and 4A-B, the lid 110 includes a stop 113 and the base 160 includes a channel 161 with an indentation 163. Thus, when the protrusion 165 has fully engaged the thread 120, the stop 113 will ride over the indentation 163 producing a tactile notification that lid 110 is coupled to base 160. By comparison, in the embodiments shown in FIGS. 3 and 4C, interior threads 120' may substantially cover the inner surface of outer wall 116' while threaded portion 165' may extend upwardly from the top surface 164' of base portion 160'. Thus, lid 110' may simply be threaded onto the feeding portion 150' until the bottom edge 118' of lid 110' sits tightly upon the top surface 164' of base annular well 162' and prevents further rotation. Regardless, in either embodiment, when engaged, lid 110, 110' and feeding portion 150, 150' may substantially seal any compartment formed therein or therebetween.

Now referring specifically to FIG. 4A, the lid of teether 100 also includes a plug 111. Plug 111 may protrude from the underside of top surface 115 and may extend through opening 167 when the lid 110 is coupled to the base. However, irrespective of whether the plug 111 is extending through base 160, the plug may engage teething portion 150, and in particular plug 111 may engage the engagement portion 180 of teething portion 150. As shown in the leftmost combination of FIG. 4A (including only lid 110 and teething member 180, not base 160), the teething member 180 may simply be slid over the plug 111. However, when the plug 111 and base 160 are used in combination, they may securely couple the teething member 180 to the base 160 and lid 150 of teether 100, as the plug 111 will ensure that the engagement portion 182 cannot bend or deform inwards and decouple from interior edge 169 of base 160. Furthermore, due to this arrangement, plug 111 may seal teething portion 150 and ensure that no foodstuff escapes the feeding portion 150 and passes into base 160 during use. Thus, plug 111 may make teether 100 easier to use and clean. While plug 111 is only shown in teether 100, it is to be understood that such a feature may be incorporated into any desirable embodiment, such as teether 100'.

Turning now to FIG. 4C, lid 110' is shown decoupled from the feeding portion 150' so that foodstuff, such as food or a food insert 400 may be inserted into feeding portion 150'. As can be seem in FIG. 4C, in this embodiment, the engagement portion 182' extends through opening 167' and interiorly of the annular exterior wall 162' of base portion 160', similar to how engagement portion 182 is used in teether 100. However, as mentioned, any desirable connection or engagement may be utilized to connect or engage teething portion 150' with base 160'. Regardless, once the lid 110' is decoupled from the feeding portion 150' a food insert 400 may be inserted into the feeding member 180' through an opening 167' in the engagement portion 182'. In some embodiments, such as the embodiment shown in FIG. 4C, opening 167' and, thus, feeding member 180', may be sized to receive an insert 400 and a piece of food at the same time. As will be described later, the insert 400 may be specifically formed for the feeding member 180' and may be a frozen disk of foodstuff such that melts as it rests in an infant's mouth. Although this process was described with reference to teether 100', it is to be understood that a similar insert loading process can be used with teether 100.

Referring now to FIG. 5, feeding kit 10 is shown with teether 100 and cover 250 removed from tray 210 of the housing 200. As can be seen in FIG. 5, tray 210 includes a bottom 230, an outer wall 220 extending upward from bottom 230 and wells 232 and a teether receptacle 236 formed in bottom 230. Outer wall 220 extends between an interior edge 222 and an outside peripheral edge 224 such that an edge with some thickness and handles 226 are formed around the periphery of tray 210. In the exemplary embodiment of FIG.

5, handles 226 are formed between interior edge 222 and outside peripheral edge 224 on opposite, lateral sides of tray 210.

Still referring to FIG. 5, any desirable number of wells 232 can be included in tray 210 in any desirable arrangement. For example, this embodiment includes six wells 232 arranged around the teether receptacle 236. Each well 232 also includes an exterior edge 234 that extends upwardly from bottom 230 in order to further define each well 232. Additionally, in this embodiment, wells 232 are slightly oval-shaped such that any liquids placed therein may be frozen into a cylindrical disk, but in other embodiments, wells 232 may be any desirable shape. For example, in some embodiments, wells 232 may be have a base and a semi-cylindrical portion extending perpendicularly therefrom, such that any frozen disk removed therefrom resembles the shape of feeding portion 150. The teether receptacle 236 also includes an exterior edge 237 which further defines the receptacle 236, but is sized to receive teether 100 or 100'. Receptacle 236 also includes an opening 238 which may allow a portion of an inserted teether 100, 100' to be accessed from the underside of housing 200, or in other embodiments, to drip dry exteriorly of housing 200.

Still referring to FIG. 5, cover 250 includes a top 260 and a skirt 266 extending downwardly therefrom. In some embodiments, the skirt 266 may include detents or recesses 268 on either lateral edge of cover 250. The top 260 also includes an opening 262, which in the embodiment depicted in FIG. 5, is disposed centrally in cover 250, and further defined by an interior wall 270 (see FIG. 6). Finally, cover 250 may also include detents 268 on either lateral end in order to assist in removal of the cover 250 from tray 210.

Figure 6:
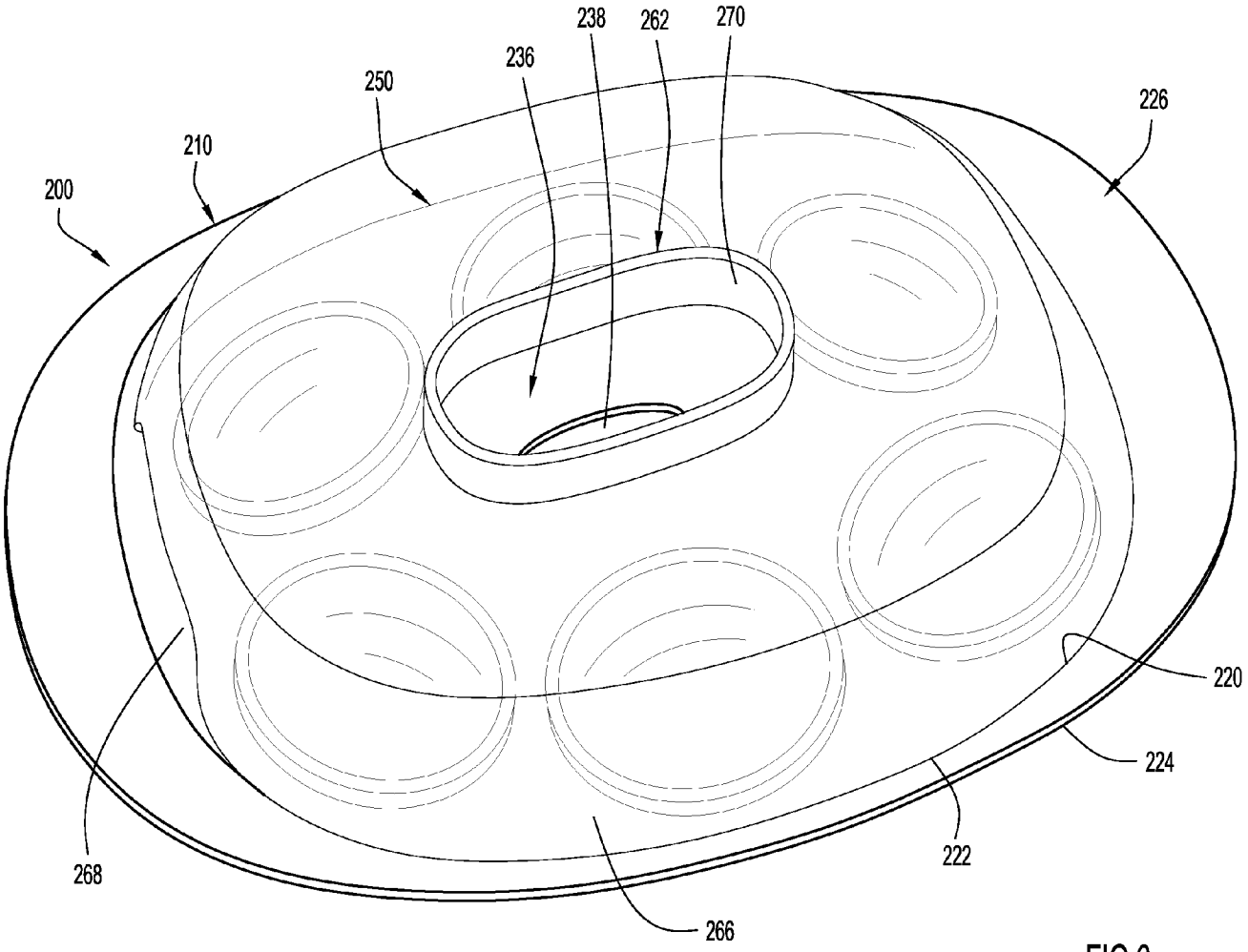
FIG. 6 shows a top perspective view of the housing from the feeding kit shown in FIG. 1.

Now referring to FIG. 6, housing 200 is shown with cover 250 placed on top, or covering, tray 210. As can be seen in FIG. 6, when cover 250 is used to cover tray 210, detents 268 may substantially align with handles 226 making it easy to carry the housing 200 or to remove the cover 250 from tray 210. Furthermore, when cover 250 is placed atop of tray 210, the skirt 266 may be inserted between the exterior edges 234 of wells 232 and the interior edge 222 of outer wall 220 such that cover 250 is prevented from sliding with respect to tray 210. Finally, when cover 250 is placed onto tray 210, opening 262 may substantially align with receptacle 236 such that opening 262 and receptacle 236 form a holder for a teether, such as teether 100 or 100'. In some embodiments, cover 250 may include an interior wall 270, and the interior wall may rest atop of the exterior edge 237 of receptacle 236, such that when a teether is inserted therein, it is separated from wells 232. This feature may prevent any fluids or substance contained within a teether from entering wells 232 and being included in any inserts 400 produced by wells 232. In other embodiments, and as shown below, the interior wall 270 may actually form a compartment that sits within receptacle 236 and also serves this purpose.

Figure 7A:
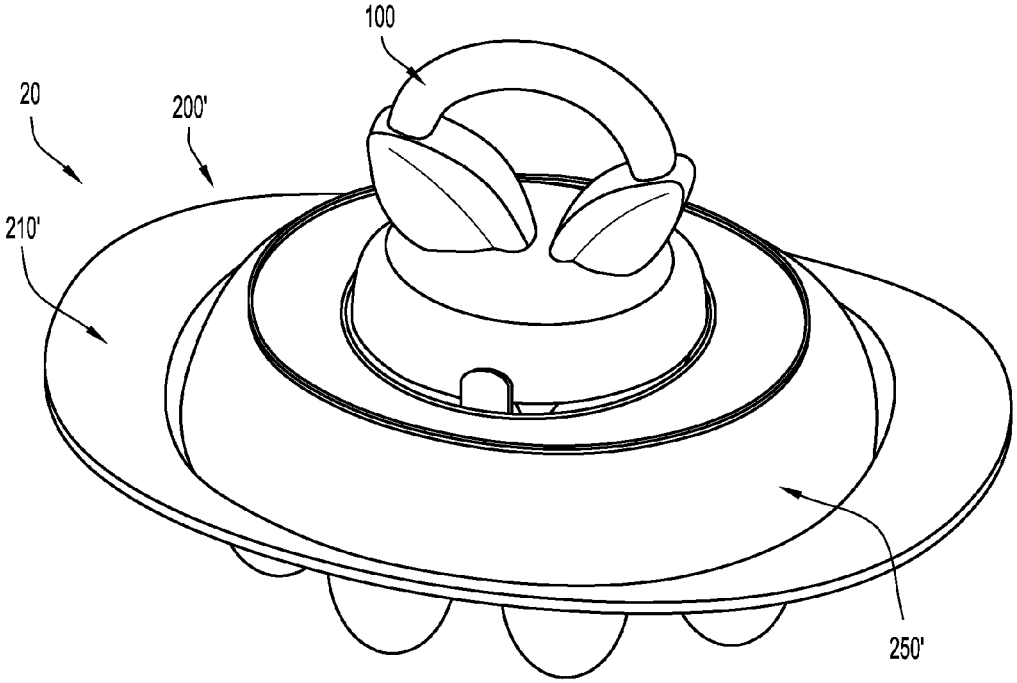
FIGS. 7A-D show various perspective views of another exemplary embodiment of a feeding kit in accordance with the present invention.

Referring next to FIG. 7A-D, another exemplary feeding kit 20 in accordance with the present invention is shown. As shown in FIG. 7A, feeding kit 20 includes teether 100 and another exemplary embodiment of a housing: housing 200'. However, since housing 200' is very similar to housing 200, housing 200' is labeled with similar reference numbers to those used in connection with housing 200. For example, housing 200' includes a tray 210' and a cover 250' that, together, can receive a teether 100 therein. However, in this embodiment, among some other slight variations, the cover 250' includes a receptacle 262', as opposed to opening 262 (see FIG. 6B and FIG. 5 for comparison) which may substantially encapsulate or encircle teether 100 so that no liquid runoff from teether 100 may reach tray 210' or any support surface thereunder. Additionally, as will be explained in more detail below, tray 210' varies slightly from the tray 210 of feeding kit 10.

Figure 7B:
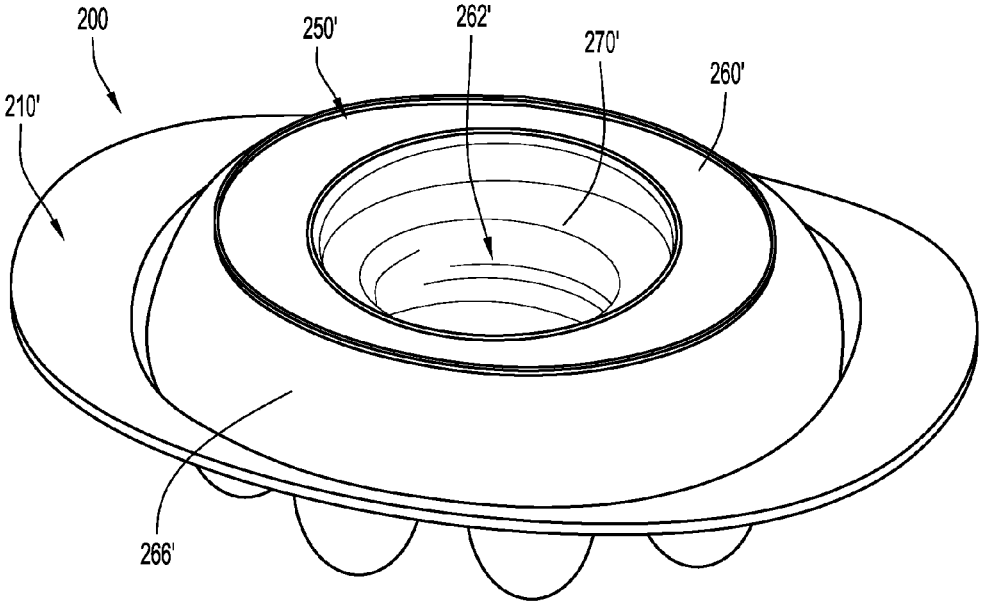

Now turning to FIG. 7B, cover 250' includes a top 260' and a skirt 266' extending downwardly therefrom. The top 260' also includes a receptacle 262', which in the embodiment depicted in FIG. 7B, is disposed centrally in cover 250', and further defined by an interior wall 270'. As seen best in FIG. 7D, in this embodiment, the receptacle 262' actually extends downwards from top 260' further than the skirt 266'. Consequently, the cover 250' may not be able to sit flat on a support surface, but may also extend through the tray 210' such that the teether appears further embedded within the tray 210' when stored therein. In fact, the interior wall 270' may be stepped or contoured, if desired, such that the receptacle 262' may receive at least a portion of base 160 and/or lid 110. This allows the teether 100 to sit deeper within the housing 200', as can be seen by comparing the position of teether 100 in FIG. 7A with the position of teether 100 in FIG. 1.

Figure 7C:
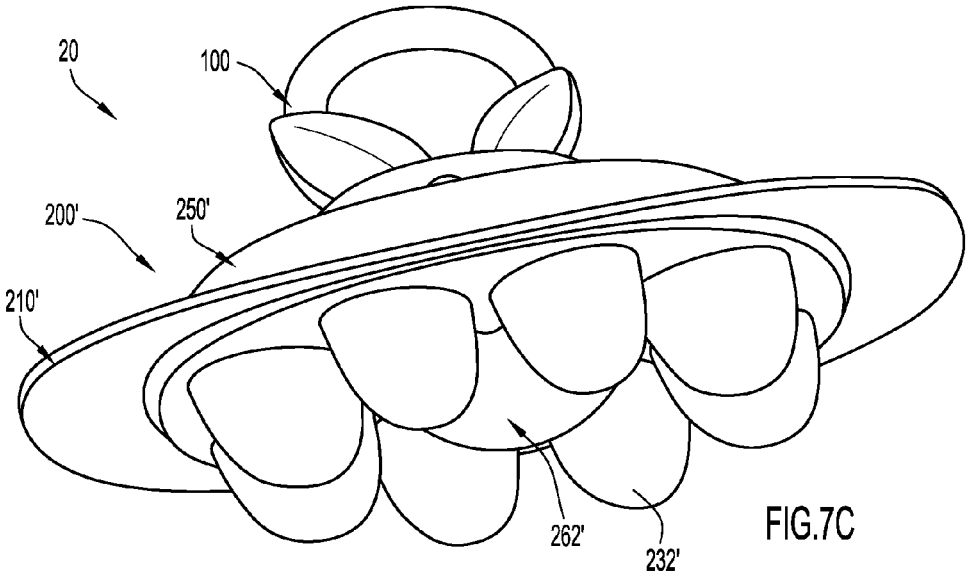
Figure 7D:
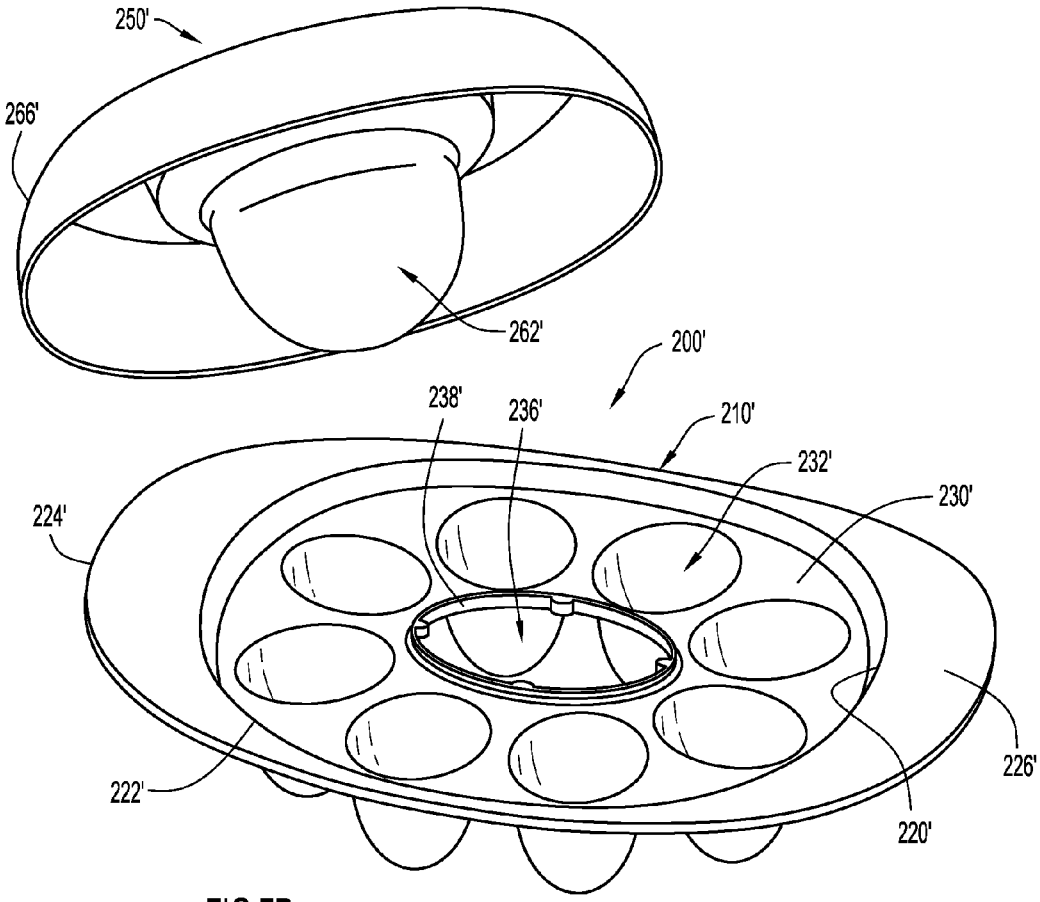

Next referring to FIG. 7C-D, tray 210' is shown with cover 250' mounted thereon and removed, respectively. As can be seen, tray 210' again includes an outer wall 220' extending upward from a bottom 230'. Further, wells 232' and a teether receptacle 236' are again formed in bottom 230' and the outer wall 220' still extends between an interior edge 222' and an outside peripheral edge 224' such that an edge with some thickness and handles 226' are formed around the periphery of tray 210'. In the exemplary embodiment of FIGS. 7C-D, handles 226' are formed between interior edge 222' and outside peripheral edge 224' on opposite, lateral sides of tray 210'.

Still referring to FIGS. 7C-D, a plurality of wells 232' and a teether receptacle 236' are formed in the bottom 230' of tray 210'. However, in this embodiment, eight wells 232' (as opposed to six wells 232) shaped substantially similarly to teething member 184 are arranged around the teether receptacle 236'. Also in contrast with tray 210, wells 232' do not include exterior edges 234 (see FIG. 5) that extend upwardly from bottom 230' in order to further define each well 232'. Instead, the wells 232' simply extend downwardly from bottom 230' with no explicit boundary therebetween. Finally, tray 210' also includes a teether receptacle 236', but in this embodiment, teether receptacle 236' is simply an opening surrounded by a raised edge 238'. Preferably, edge 238' is sized to prevent any liquid that is overflowing from wells 232' or sitting on bottom 230' from entering teether receptacle 236', thereby ensuring the support surface underneath housing 200' remains dry.

Figure 8:
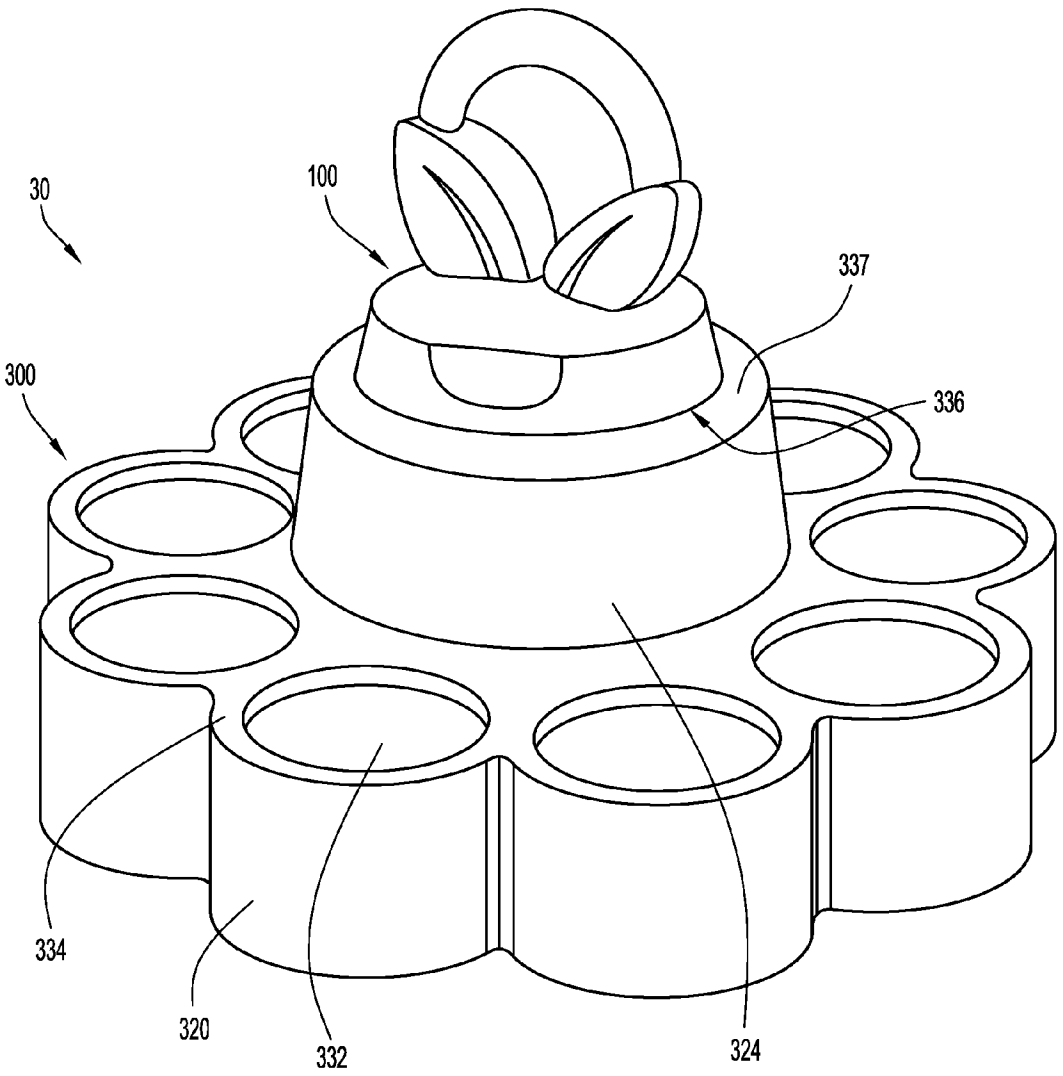
FIG. 8 shows a front perspective view of another exemplary embodiment of a feeding kit in accordance with the present invention.

Referring now to FIG. 8, another exemplary feeding kit, feeding kit 30 in accordance with the present invention, is shown from a front perspective. Feeding kit 30 includes a housing 300 designed to receive a feeding teether, such as feeding teether 100, and various wells 332, but does not include a cover. In this embodiment, eight wells 332 are included around a central teether receptacle 324 and the central receptacle 324 is raised above the wells 332. Similar to kit 10, wells 332 are ovular or circular and also include an exterior edge 334 to further define each well, but in contrast, the central receptacle is also circular and, thus, may receive the base portion 160, 160' of a teether 100, 100' instead of just the teething member 184, 184'. Regardless, kit 30 still provides wells 332 for forming food inserts 400 and a receptacle for storing a teether, such that kit 30 still provides a convenient and simple feeding kit.

In use, any type of solid or liquid foodstuff may be poured or placed into the wells 232, 232', 332 of feeding kit 10, 20, or 30. Then, the entire kit 10, 20, 30 can be placed in a freezer, or other cold area, such that any foodstuff placed into wells 232, 232', 332 may be formed into a frozen or chilled food insert 400. A food insert 400 may be any shape or portion of a shape, as dictated by the shape of wells 232, 232', and 332 and the amount of substance placed therein, and once removed from the housing 200, 200', 300, the food insert 400 may be inserted through the base portion 160, 160' of the teether 100, 100' and into the feeding member 180, 180' (when the lid 110, 110' is decoupled from the feeding portion 150, 150'). After a food insert 400 is placed in the teething member 180, 180' the lid 110, 110' may be coupled to the feeding portion 150, 150' and the teether 100, 100' may be given to a child to soothe teething pain, satiate hunger, some combination thereof, or any other desirable reason. When the child is done, wells 232, 232', 332 may be refilled, perhaps with juice, formula, water, flavored water, chopped food, or similar substances, while the teether 100, 100' is washed. Once the teether 100, 100' is cleaned, it may be placed back in the housing 200, 200', 300, (via opening 262 or receptacle 262') and the entire kit may continue to be stored in any desirable area, such as a freezer, so that it may be conveniently used again at a later time.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A feeding kit comprising:
- a teether, the teether comprising:
  - a lid including a handle; and
  - a feeding portion removably coupled to the lid and including:
    - a flexible feeding member of a shape and a size; and
    - an opening that provides access to an interior of the flexible feeding member; and
- a housing comprising:
  - a receptacle configured to receive the teether; and
  - a plurality of wells, each well being sized to form a frozen insert of the shape and the size of the feeding member for insertion into the flexible feeding member via the opening.

2. The feeding kit of claim 1, wherein the feeding member comprises a soft perforated material.

3. The feeding kit of claim 1, wherein the housing further comprises:
- a tray, the plurality of wells being formed in the tray; and
- a cover, the cover being selectively engageable with the tray and configured to substantially cover the plurality of wells.

4. The feeding kit of claim 3, wherein the tray includes the receptacle and the cover includes an opening, the opening being aligned with the receptacle and configured to allow a teether to extend through the cover and rest in the receptacle.

5. The feeding kit of claim 4, wherein the receptacle is disposed in a central portion of the tray and the plurality of wells are disposed around the receptacle.

6. The feeding kit of claim 3, wherein the cover includes the receptacle and the tray includes an opening, the receptacle being configured to receive the teether and the opening being aligned with the receptacle and configured to allow the receptacle to extend therethrough.

7. The feeding kit of claim 1, wherein the feeding kit resembles a planted plant.

8. The feeding kit of claim 1, wherein the wells are oval-shaped.

9. A feeding kit comprising:
- a teether comprising:
  - a lid including a handle; and
  - a feeding portion with a plurality of perforations, the feeding portion having an opening that is selectively sealable by the lid; and
- a housing comprising:
  - a freezable tray including a plurality of fluid receiving wells, each well forming a frozen insert sized for insertion into the feeding portion;
  - a cover configured to cover the plurality of wells; and
  - a receptacle configured to receive at least a portion of the teether.

10. The feeding kit of claim 9, wherein the receptacle is formed in the tray and the cover includes an opening aligned with the receptacle.

11. The feeding kit of claim 10, wherein the receptacle includes an opening to allow the teether to be accessed from beneath the receptacle.

12. The feeding kit of claim 9, wherein the receptacle is formed in the cover and the tray includes an opening that is aligned with the receptacle and configured to allow the receptacle to extend therethrough.

13. The feeding kit of claim 12, wherein the receptacle is contoured to the exterior dimensions of at least a portion of the teether.

14. The feeding kit of claim 13, wherein the teether further comprises:
- a base, the base being removably coupleable to the lid and removably engageable with the feeding portion, and the receptacle being contoured to receive the feeding portion and at least a portion of the base therein.

15. A feeding kit comprising:
- a teether comprising:
  - a lid including a handle; and
  - a feeding portion with a plurality of perforations, the feeding portion having an opening that is selectively sealable by the lid; and
- a housing comprising:
  - a tray including:
    - a plurality of wells, each well being sized to form a frozen insert configured to be inserted into and substantially fill the feeding portion; and
    - a teether receptacle; and
  - a cover configured to cover the plurality of wells, the cover including a portion configured to receive the teether, the teether receptacle being sized to selectively receive at least one of the teether and a portion of the cover.

16. The feeding kit of claim 15, wherein the portion of the cover configured to receive the teether is an opening and the teether receptacle substantially surrounds the teether when the teether is inserted through the opening and into the teether receptacle.

17. The feeding kit of claim 15, wherein the portion of the cover configured to receive the teether is a receptacle and the teether receptacle is an opening which allows the receptacle to extend therethrough.

18. The feeding kit of claim 15, wherein the lid may threadably engage the feeding portion.

19. The feeding kit of claim 15, wherein the teether further comprises:

a plug selectively sealing the feeding portion when the lid seals the feeding portion so that foodstuff only exits the feeding portion via the perforations when the plug is sealing the feeding portion.

* * * * *